US009141053B2

(12) United States Patent
Matsumoto et al.

(10) Patent No.: US 9,141,053 B2
(45) Date of Patent: Sep. 22, 2015

(54) HEATING DEVICE, FIXING DEVICE, AND IMAGE FORMING APPARATUS

(71) Applicant: FUJI XEROX CO., LTD., Minato-ku, Tokyo (JP)

(72) Inventors: Mitsuhiro Matsumoto, Kanagawa (JP); Yasuhiro Uehara, Kanagawa (JP); Kazuyoshi Ito, Kanagawa (JP); Hideaki Ohara, Kanagawa (JP); Mikio Saiki, Kanagawa (JP); Hiroki Murakami, Kanagawa (JP); Kimiyuki Kawakami, Kanagawa (JP); Junji Okada, Kanagawa (JP); Tadashi Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/273,023

(22) Filed: May 8, 2014

(65) Prior Publication Data

US 2015/0160590 A1 Jun. 11, 2015

(30) Foreign Application Priority Data

Dec. 5, 2013 (JP) ..... 2013-252315

(51) Int. Cl.
*G03G 15/20* (2006.01)

(52) U.S. Cl.
CPC ..... *G03G 15/206* (2013.01); *G03G 15/2053* (2013.01); *G03G 15/2064* (2013.01); *G03G 15/2089* (2013.01); *G03G 2215/2016* (2013.01); *G03G 2215/2032* (2013.01)

(58) Field of Classification Search
CPC ..... G03G 15/20
USPC ..... 399/329
See application file for complete search history.

(56) References Cited

U.S. PATENT DOCUMENTS

2003/0147680 A1* 8/2003 Kawamura et al. ..... 399/329
2011/0229227 A1* 9/2011 Yoshikawa et al. ..... 399/329

FOREIGN PATENT DOCUMENTS

JP 2001-249566 * 9/2001 ..... G03G 15/20
JP 2001-249566 A 9/2001
JP 2002-214951 A 7/2002
JP 2010-117598 * 5/2010 ..... G03G 15/20

(Continued)

OTHER PUBLICATIONS

Japanese Office Action Issued Sep. 16, 2014 in corresponding Japanese Patent Applicaton No. 2013-252315.*

(Continued)

*Primary Examiner* — Clayton E Laballe
*Assistant Examiner* — Kevin Butler
(74) *Attorney, Agent, or Firm* — Sughrue Mion, PLLC

(57) ABSTRACT

Provided is a heating device that heats a belt which transports a medium on which a non-fixed image to be fixed onto the medium through heating is formed, the heating device including a heating element, a first insulating layer and a second insulating layer that are arranged to nip the heating element, a first supporting layer that comes into contact with the first insulating layer and a second supporting layer that comes into contact with the second insulating layer, both of which are arranged to nip the first insulating layer, the heating element, and the second insulating layer, and a connection member that connects the first supporting layer and the second supporting layer in a normal direction of the first supporting layer and the second supporting layer.

18 Claims, 7 Drawing Sheets

(56) References Cited

FOREIGN PATENT DOCUMENTS

| | | | | |
|---|---|---|---|---|
| JP | 2010-117598 A | | 5/2010 | |
| JP | 2010-177142 | * | 8/2010 | ..... G03G 15/20 |
| JP | 2010-177142 A | | 8/2010 | |

OTHER PUBLICATIONS

Japanese Office Action issued Sep. 16, 2014 in corresponding Japanese Patent Application No. 2013-252315.

* cited by examiner

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2013-252315 filed Dec. 5, 2013.

BACKGROUND

Technical Field

The present invention relates to a heating device, a fixing device, and an image forming apparatus.

SUMMARY

According to an aspect of the invention, there is provided a heating device that heats a belt which transports a medium on which a non-fixed image to be fixed onto the medium through heating is formed, the heating device including:

a heating element;

a first insulating layer and a second insulating layer that are arranged to nip the heating element;

a first supporting layer that comes into contact with the first insulating layer and a second supporting layer that comes into contact with the second insulating layer, both of which are arranged to nip the first insulating layer, the heating element, and the second insulating layer; and a connection member that connects the first supporting layer and the second supporting layer in a normal direction of the first supporting layer and the second supporting layer.

BRIEF DESCRIPTION OF THE DRAWINGS

Exemplary embodiments of the present invention will be described in detail based on the following figures, wherein.

DETAILED DESCRIPTION

1. Exemplary Embodiment

Figure 1:
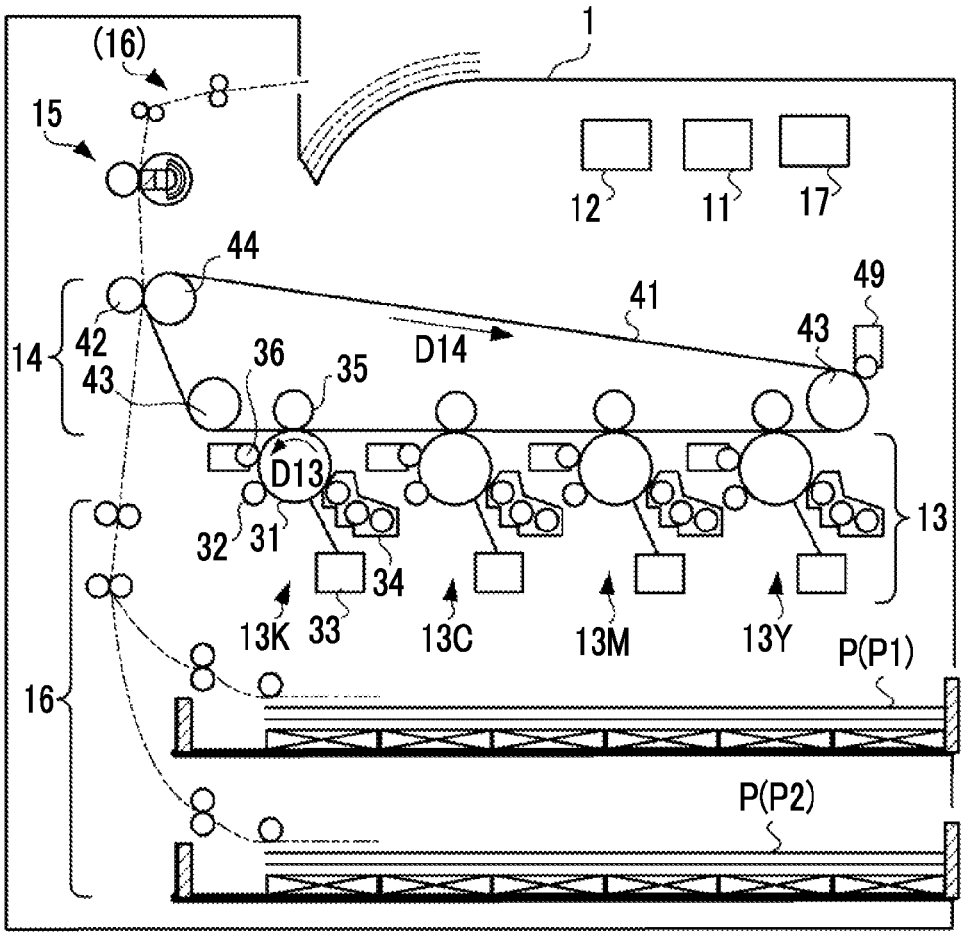
FIG. 1 is a view illustrating an overall configuration of an image forming apparatus.

FIG. 1 is a view illustrating an overall configuration of an image forming apparatus 1 according to an exemplary embodiment of the invention. The image forming apparatus 1 is an apparatus that forms an image by using an electrophotography method. The image forming apparatus 1 according to this exemplary embodiment is of so-called tandem type, and forms the image on a sheet P, which is an example of a medium, based on image data representing the image. A control unit 11 in the drawing has a central processing unit (CPU), a read only memory (ROM), and a random access memory (RAM), and controls each unit of the image forming apparatus by the CPU reading and executing a computer program (hereinafter, simply referred to as a program) that is stored in the ROM and a storage unit 12. The storage unit 12 is a large-capacity storage unit such as a hard disk drive, and stores the program that is read by the CPU of the control unit 11. An operation unit 17 has an operation button and the like, which are used to input various instructions, receives an operation from a user, and supplies a signal, corresponding to a content of the operation, to the control unit 11.

Developing units 13Y, 13M, 13C, and 13K form toner images on a sheet P. The signs of Y, M, C, and K mean that these are configured to correspond respectively to yellow, magenta, cyan, and black toner. The developing units 13Y, 13M, 13C, and 13K have no large difference in configuration from one another, except that the toner which are used are different. Hereinafter, the developing units 13Y, 13M, 13C, and 13K are referred to as "developing units 13", with the alphabets showing the colors of the toner at the ends of the respective signs omitted, when the developing units 13Y, 13M, 13C, and 13K do not have to be distinguished from one another.

Each of the developing units 13 has a photoconductor drum 31, a charging unit 32, an exposure device 33, a developing unit 34, a primary image transfer roller 35, and a drum cleaner 36. The photoconductor drum 31 is an image holding member that has a charge generation layer and a charge transporting layer, and is rotated in an arrow D13 direction in the drawing by a driving unit (not illustrated). The charging unit 32 charges an outer surface of the photoconductor drum 31. The exposure device 33 has a laser light-emitting source (not illustrated), a polygon mirror (not illustrated), and the like, and irradiates the photoconductor drum 31 that is charged by the charging unit 32 with laser light corresponding to the image data under the control by the control unit 11. In this manner, a latent image is held in each of the photoconductor drums 31. The above-described image data may be acquired by the control unit 11 from an external device via a communication unit (not illustrated). Examples of the external device include a reader that reads an original image, and a storage device that stores data showing an image.

The developing unit 34 accommodates toner of any of the Y, M, C, and K colors and a two-component developer containing a magnetic carrier such as ferrite powder. When a tip of a magnetic brush that is formed in the developing unit 34 comes into contact with the outer surface of the photoconductor drum 31, the toner adheres to a part of the outer surface of the photoconductor drum 31 that is exposed by the exposure device 33, that is, a streak portion of an electrostatic latent image and the image is formed (developed) in the photoconductor drum 31.

An intermediate image transfer belt 41 of a transfer portion 14 generates a predetermined potential difference at a position facing the photoconductor drum 31, and the primary image transfer roller 35 transfers the image to the intermediate image transfer belt 41 by using the potential difference. The drum cleaner 36 removes the non-transferred toner that remains on the outer surface of the photoconductor drum 31 after the image transfer, and removes electricity of the outer surface of the photoconductor drum 31. In other words, the drum cleaner 36 removes unnecessary toner and a charge from the photoconductor drum 31 in preparation for subsequent image formation.

The transfer portion 14 has the intermediate image transfer belt 41, a secondary image transfer roller 42, a belt transport roller 43, and a backup roller 44. The transfer portion 14 is a transfer portion that transfers the image, which is formed by the developing units 13, onto the sheet P, the type of which is determined according to the user operation. The intermediate image transfer belt 41 is an endless belt member, and the belt transport roller 43 and the backup roller 44 stretches the intermediate image transfer belt 41. At least one of the belt transport roller 43 and the backup roller 44 is provided with a driving unit (not illustrated) that moves the intermediate image transfer belt 41 in an arrow D14 direction in the drawing. The belt transport roller 43 or the backup roller 44 that is not provided with the driving unit is driven to rotate with following the movement of the intermediate image transfer belt 41. As the intermediate image transfer belt 41 is moved in the arrow D14 direction in the drawing and is rotated, the image on the intermediate image transfer belt 41 is moved to an area nipped by the secondary image transfer roller 42 and the backup roller 44.

The secondary image transfer roller 42 transfers the image on the intermediate image transfer belt 41 onto the sheet P, which is transported from a transport unit 16, by using the potential difference between the secondary image transfer roller 42 and the intermediate image transfer belt 41. A belt cleaner 49 removes the non-transferred toner that remains on an outer surface of the intermediate image transfer belt 41. Then, the transfer portion 14 or the transport unit 16 transports the sheet P, where the image is transferred, to a fixing unit 15. The developing unit 13 and the transfer portion 14 are examples of image forming unit that form the image on a medium of the exemplary embodiment of the invention.

The transport unit 16 (example of a transport unit) has containers and transport rollers. The sheet P as an example of the medium, which is cut to a predetermined size and has the non-fixed image, which is fixed onto the medium through heating, formed thereon, is accommodated in the container. As for the size of the sheet P, at least two different sizes are determined in a direction vertical to a transport direction, that is, a width direction. Herein, two types of the sheets P are used, one being a maximum width sheet P1 and the other being a small width sheet P2 that is narrower in width than the maximum width sheet P1. The maximum width sheet P1 refers to the sheet having the largest size in the width direction among the sheets P handled by the image forming apparatus 1. The two types of the sheets P are distinguished by the control unit 11 according to the containers in which the sheets P are accommodated. The sheets P that are accommodated in the respective containers are taken out, sheet by sheet, by the instruction from the control unit 11 and the transport rollers, and are transported to the transfer portion 14 through a sheet transport path. The medium is not limited to the sheet. For example, the medium may be a resinous sheet. In short, the medium may be any medium insofar as the image may be formed on an outer surface of the medium.

Figure 2:
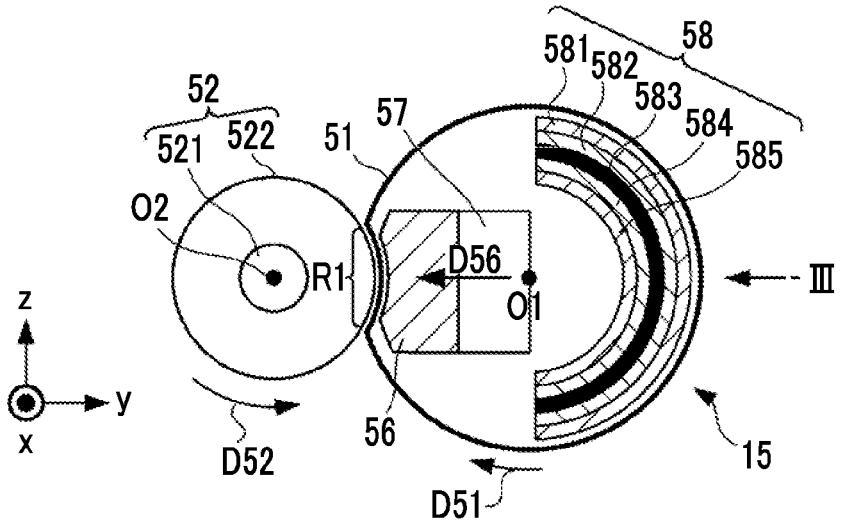
FIG. 2 is a view illustrating an overview of a fixing unit.

The fixing unit 15 (example of a fixing device) fixes the image, which is transferred to the sheet P, through heating. FIG. 2 is a view illustrating an overview of the fixing unit 15. Hereinafter, a space in which each configuration of the fixing unit 15 is arranged in the drawing is shown as an XYZ right-handed coordinate space to describe the arrangement of each configuration. Of the coordinate symbols illustrated in the drawing, the symbol of a black circle in a circle that is white on the inner side represents an arrow directed from a page face depth side to a front side. In the space, a direction along an X axis will be referred to as an X-axis direction. Of the X-axis direction, a direction in which an X component increases will be referred to as a +X direction and a direction in which the X component decreases will be referred to as a −X direction. A Y-axis direction, a +Y direction, a −Y direction, a Z-axis direction, a +Z direction, and a −Z direction are also defined for Y and Z components. When the sheet P passes through the fixing unit 15, the sheet P is transported in the Z-axis direction in a state where the surface where the image is formed is directed toward the +Y direction. In other words, the Z-axis direction is the transport direction of the sheet P, and the X-axis direction is the width direction of the sheet P.

The fixing unit 15 has a fixing belt 51, a pressurizing roller 52, a pressing pad 56, a holder 57, and a heating unit 58. As illustrated in FIG. 2, the fixing belt 51 rotates in an arrow D51 direction about an axis O1 that is parallel to the X-axis direction. In addition, as illustrated in FIG. 2, the pressurizing roller 52 has a metallic and cylindrical core material 521, and an elastic layer 522 that is disposed on an outer surface of the core material 521. The core material 521 rotates in an arrow D52 direction about an axis O2, which is an axis parallel to the axis O1 and arranged in the −Y direction of the axis O1, and causes the elastic layer 522 to rotate in the arrow D52 direction. Examples of materials of the elastic layer 522 include a silicone rubber layer and a fluorine rubber layer. In addition, the elastic layer 522 may be provided with an outer surface release layer (fluorine resin layer) on an outer surface of the elastic layer 522. The pressurizing roller 52 presses the sheet P, which is transported by the transport unit 16, to the fixing belt 51 while being rotated by a driving unit (not illustrated) to assist in the heating of the sheet P with the fixing belt 51. The fixing belt 51 is driven to be rotated by the pressurizing roller 52 due to a frictional force from the pressurizing roller 52.

The pressing pad 56, the holder 57, and the heating unit 58 are arranged on an inner circumferential side of the fixing belt 51. The holder 57 is a rod-shaped member that extends in the X-axis direction, and both end portions (not illustrated) of the holder 57 are fixed to a housing of the image forming apparatus 1. The holder 57 is formed by using a heat-resistant resin such as glass-filled PPS (polyphenylene sulfide) and a non-magnetic metal such as gold (Au), silver (Ag), aluminum (Al), and copper (Cu). The holder 57 supports the pressing pad 56 to press the pressing pad 56 in an arrow D56 direction (−Y direction) illustrated in FIG. 2, that is, a direction toward the pressurizing roller 52.

The pressing pad 56 is formed of a heat-resistant resin such as liquid crystal polymer (LCP), and is supported by the holder 57 at a position facing the pressurizing roller 52. The pressing pad 56 is arranged in a state where the pressing pad 56 is pressed from the pressurizing roller 52 via the fixing belt 51, and presses the fixing belt 51 from inside toward the direction (−Y direction) of the pressurizing roller 52. In this manner, a nip area R1 is formed between the fixing belt 51 and the pressurizing roller 52. The sheet P is transported to pass through the nip area R1. In the nip area R1, the pressing pad 56 is deformed to be recessed toward the axis O1 due to the pressing by the pressurizing roller 52, and the fixing belt 51 has a shape that follows the deformed shape of the pressing pad 56. The pressing pad 56 may be formed of an elastomer such as silicone rubber and fluorine rubber.

The heating unit 58 is a member that heats the fixing belt 51. The heating unit 58 is an example of a heating device according to the exemplary embodiment of the invention. The heating unit 58 is provided with a metal layer 581 (example of a first supporting layer), an insulating layer 582, a metal layer 583, an insulating layer 584, and a metal layer 585 (example of a second supporting layer) that are stacked in this order from an inner circumferential surface side of the fixing belt 51 toward the axis O1. The heating unit 58 has a shape in which a rectangular planar member, where the metal layer 581, the insulating layer 582, the metal layer 583, the insulating layer 584, and the metal layer 585 are laminated, is curved in an arc shape about the axis O1. The heating unit 58 has a plane size of, for example, approximately 100 mm×400 mm in a non-curved state. The heating unit 58 may be formed by being curved after the metal layer 581, the insulating layer 582, the metal layer 583, the insulating layer 584, and the metal layer 585 that have planar shapes are laminated, or may be formed by laminating the metal layer 581, the insulating layer 582, the metal layer 583, the insulating layer 584, and the metal layer 585 that have curved shapes.

In this exemplary embodiment, the metal layer 581 is a stainless steel layer with a thickness of 10 μm to 100 μm. The metal layer 581 has functions as a temperature equalizer and a heat-accumulation material. In addition, the metal layer 581 functions to prevent floating and peeling, which are caused by a thermal expansion of the metal layer 583 and the insulating layers 582 and 584, by using rigidity of the metal layer 581. A surface of the metal layer 581 on the side opposite to the insulating layer 582, that is, an outer surface that is an outer side when the heating unit 58 has an arc shape, comes into contact with the fixing belt 51 to support the fixing belt 51. Examples of shapes of the metal layer 581 include a shape in which a part corresponding to a range (for example, 30° to 180°) of a predetermined central angle is cut from an alloy formed into a cylindrical shape with the thickness described above. However, the shape is not particularly limited.

The metal layer 583 is covered by the insulating layer 582 and is positioned inside the metal layer 581. In this exemplary embodiment, the metal layer 583 is disposed over a direction (longitudinal direction of the heating unit 58) that intersects with the arrow D51 direction, which is the direction in which the fixing belt 51 is moved.

Figure 3A:
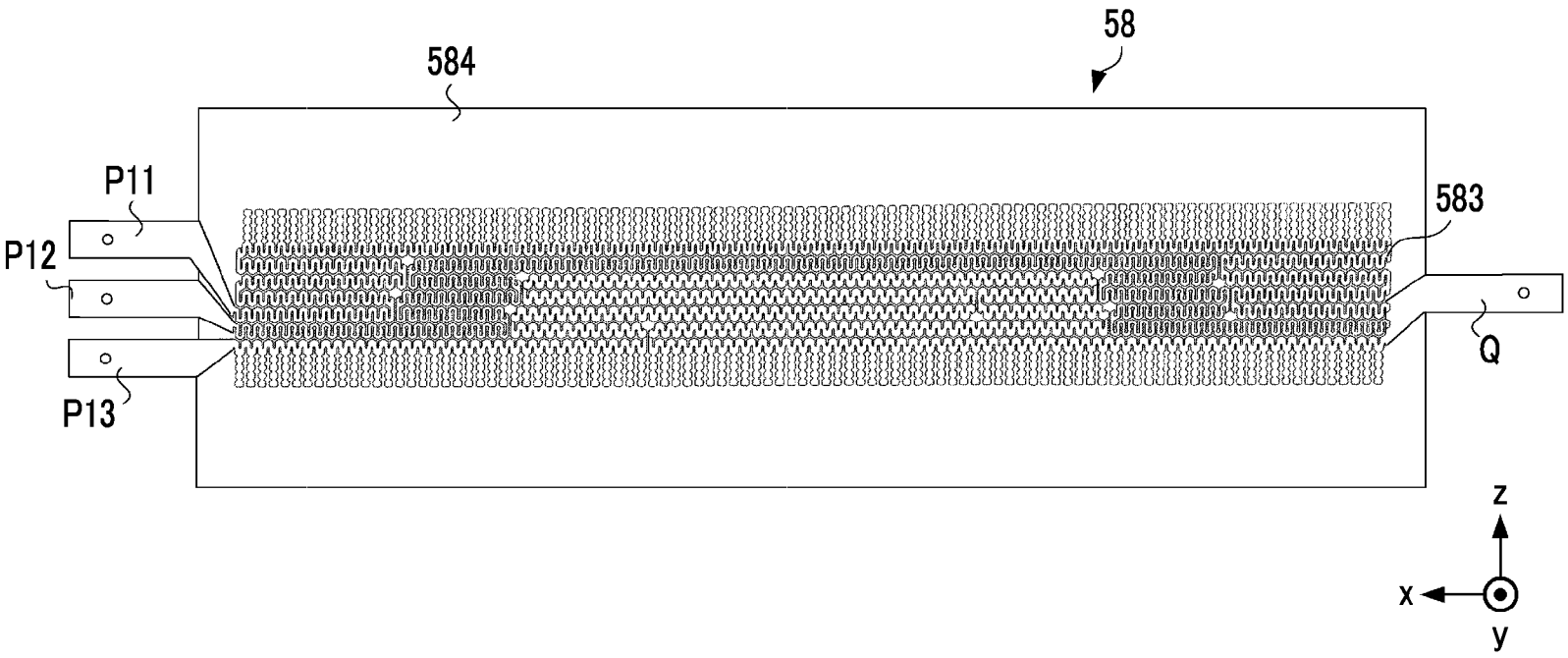
FIG. 3A is a view illustrating a heating element viewed from an arrow III of FIG. 2.
Figure 3B:
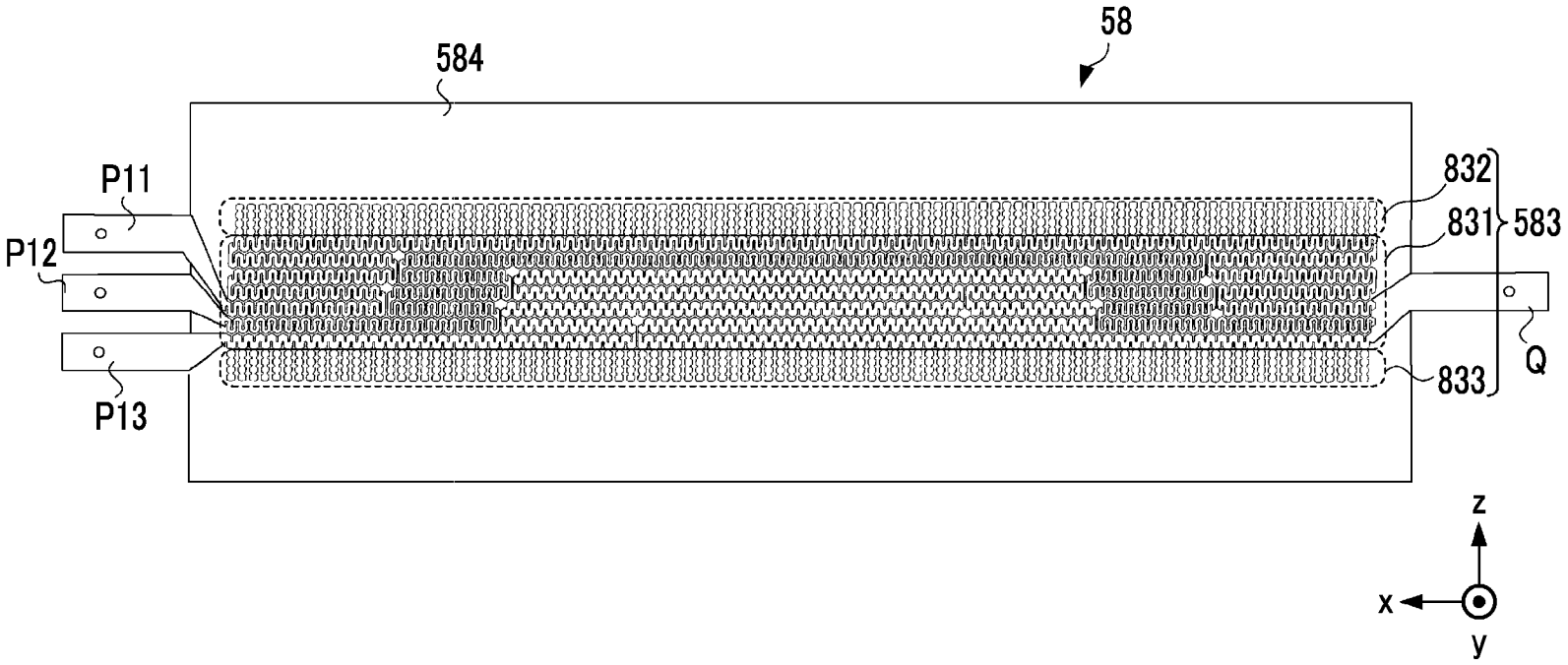
FIG. 3B is a view illustrating the heating element viewed from the arrow III of FIG. 2.

FIGS. 3A and 3B are views illustrating the metal layer 583, viewed from an arrow III of FIG. 2, through the metal layer 581 and the insulating layer 582. FIGS. 3A and 3B illustrate the metal layer 583 and the insulating layer 584 with planar shapes, instead of the heating unit 58 being curved, so as to facilitate the understanding of the configuration of the metal layer 583. In this exemplary embodiment, the metal layer 583 is obtained by cutting a thin stainless steel plate with a thickness of 10 μm to 100 μm into the shapes illustrated in FIGS. 3A and 3B. The metal layer 583 may be formed of another material insofar as the material generates heat.

As illustrated in FIG. 3B, the metal layer 583 has a heat generating portion 831 (example of a heating element), and non-heat generating portions 832 and 833 (examples of a non-heating element). The heat generating portion 831 and the non-heat generating portions 832 and 833 are integrally formed as illustrated in FIG. 3A, and the metal layer 583 has a certain degree of rigidity. Electrodes P11 to P13 and an electrode Q are disposed in the metal layer 583, and a power source (not illustrated) is connected between each of the electrodes P11 to P13 and the electrode Q. The heat generating portion 831 generates heat when electric current flow from these power sources. An area (hereinafter, referred to as a "heated area") of the metal layer 581 relating to the heat generating portion 831 is heated by the heat generation by the heat generating portion 831, and the heat is transmitted to the fixing belt 51 in contact with the heated area such that the fixing belt 51 is heated. Slight heat generation is performed also on the non-heat generating portions 832 and 833, but the heat generation performed on the non-heat generating portions 832 and 833 is insufficient to heat the fixing belt 51.

Referring back to FIG. 2, the insulating layers 582 and 584 of this exemplary embodiment are highly heat-resistant insulating layers of, for example, a polyimide resin, an insulation vapor deposited film, and thin film ceramic. The insulating layer 582 is disposed on a lower surface side of the metal layer 581 and covers and protects the metal layer 583. The insulating layer 584 is disposed on an upper surface side of the metal layer 585 and covers and protects the metal layer 583. The material of the insulating layers 582 and 584 is not limited to the polyimide resin, and may be any other resin insofar as the material is heat-resistant.

In this exemplary embodiment, the metal layer 585 is a stainless steel layer with a thickness of 10 μm to 100 μm. The metal layer 585 supports the metal layer 583, the insulating layer 582, and the insulating layer 584, and functions to prevent the floating and the peeling, which are caused by the thermal expansion of the metal layer 583 and the insulating layers 582 and 584 by using rigidity of the metal layer 585. Examples of shapes of the metal layer 585 include a shape in which a part corresponding to a range (for example, 30° to 180°) of a predetermined central angle is cut from an alloy formed into a cylindrical shape with the thickness described above. However, the shape is not particularly limited.

Figure 4:
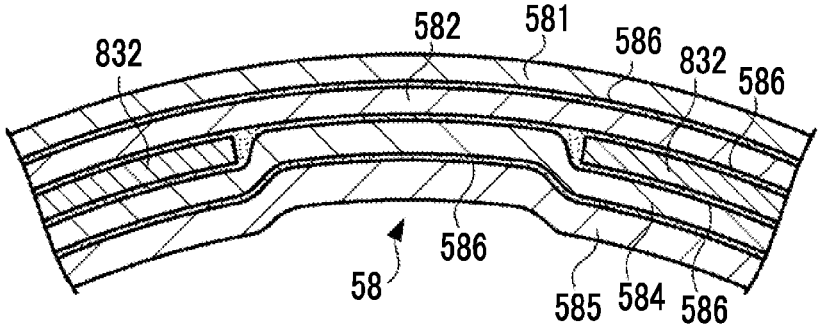
FIG. 4 is an enlarged sectional view illustrating a part of the heating unit.

FIG. 4 is an enlarged sectional view illustrating a part of the heating unit 58. The metal layers 581 and 585, the insulating layers 582 and 584, and the metal layer 583 are adhered with a thermoplastic adhesive 586 (example of a connection member) in a part of an area other than the heated area (hereinafter, referred to as a "non-heated area") or in the entire non-heated area. In other words, the metal layers 581 and 585, the insulating layers 582 and 584, and the metal layer 583 are adhered in the area other than the area where the heat generating portion 831 illustrated in FIGS. 3A and 3B is positioned. The shapes of the metal layer 581, the insulating layer 582, the metal layer 583, the insulating layer 584, the metal layer 585, and the adhesive 586 therebetween, which are illustrated in FIG. 4, are an example and may be changed to various shapes by, for example, the rigidity and viscosity of these members. The adhesive 586 adheres outer surfaces of the metal layers 581 and 585, the insulating layers 582 and 584, and the metal layer 583 that face each other. In other words, the adhesive 586 connects the metal layer 581 and the metal layer 585 in the normal direction of the metal layer 581 and the metal layer 585.

In fixing devices of the related art, a heat generating portion has a higher temperature than an insulating layer, particularly at a timing immediately after an initiation of heat generation, when the heat generating portion and the insulating layer has the same thermal expansion coefficient and when the thermal expansion coefficient of the heat generating portion is higher than the thermal expansion coefficient of the insulating layer. Accordingly, the amount of expansion of the heat generating portion is greater than the amount of expansion of the insulating layer, and a gap (floating and peeling) is generated between the heating element and the insulating layer. This becomes more remarkable when an adhesive force between the heating element and the insulating layer is reduced by use over time at an abnormally high temperature. When the gap is generated between the heat generating portion and the insulating layer, the heat that is generated by the heat generating portion may not be moved to a fixing belt and the fixing belt may not be heated to a predetermined temperature. This results in fixing failures in some cases.

Another problem is that the highly heat-resistant insulating layer is subjected to change such as embrittlement and carbonization, due to an abnormally high temperature caused by an individual heating state (so-called boiling state) of the heating element, when a metal plate is laminated on a side where the heating element and the fixing belt are in contact with each other and the gap (floating and peeling) is generated. As a result, an insulating function is reduced and electric currents flowing in the heating element leak to the metal layer to cause a low resistance area to be formed on a circuit. In this case, combined resistance of the heat generating portion is reduced and abnormal heat generation or the like occurs in some cases.

In contrast, in this exemplary embodiment, the metal layer 581 and the metal layer 585 are connected with the adhesive in the normal direction of the surfaces thereof, and thus the insulating layer 582 and the insulating layer 584, which are nipped between the metal layer 581 and the metal layer 585 are pressed from outside with respect to the metal layer 583 arranged therebetween. As a result, the gap formation (occurrence of the floating and the peeling) is suppressed between the metal layer 583 and the insulating layers 582 and 584.

In addition, in this exemplary embodiment, the laminated body of the insulating layer 582, the metal layer 583, and the insulating layer 584 is arranged to be nipped, and the metal layer 581 and the metal layer 585, which are adhered to the laminated body, are deformed to be curved such that the heating unit 58 is formed. A circumferential direction distance of an inner side surface of the heating unit 58 is shorter than a circumferential direction distance of an outer side surface of the heating unit 58, and thus the metal layer 585, in which any of the direction along the surfaces is suppressed by the adhesive 586 during the curving deformation, generates a force toward an outer side of the surface in the normal direction and presses the laminated body of the insulating layer 582, the metal layer 583, and the insulating layer 584 to the metal layer 581. As a result, adhesion between the insulating layer 582 and the metal layer 583 and adhesion between the metal layer 583 and the insulating layer 584 are higher than when the curving deformation is not performed. As such, the gap formation is suppressed.

In addition, in this exemplary embodiment, the thermoplastic adhesive is employed as the adhesive 586. Accordingly, when the metal layer 583 generates heat and reaches a high temperature, liquidity of the adhesive 586 in the vicinity thereof increases. Even when a misalignment is generated between the layers constituting the heating unit 58 due to the difference between the thermal expansion coefficients, the adhesive 586 maintains the adhesion state while allowing the misalignment. Then, when the heat generation of the metal layer 583 is stopped and the temperature is decreased, the adhesive 586 in the vicinity thereof maintains the adhesion state while allowing the misalignment and gradually reducing the liquidity. As such, the gap formation between the metal layer 583 and the insulating layers 582 and 584 is more suppressed than when the connection between the layers constituting the heating unit 58 is performed by other units such as a thermally curable adhesive and a screw. In addition, the adhesive 586 and the insulating layer 582 or the insulating layer 584 may be films that are integrally formed from the beginning. Further, the exemplary embodiment of the invention is available, if stress conditions and temperature conditions are appropriate, even when the above-described effect of the thermoplastic resin is absent, that is, when the metal layer 581, the insulating layer 582, and the like are adhered with the thermally curable resin alone.

2. Modification Example

The exemplary embodiment of the invention has been described above. The invention is not limited to the exemplary embodiment described above and may be embodied in various manners. The examples are as follows. In addition, the respective aspects below may be combined with each other.

(1) The metal layers 581 and 585, the insulating layers 582 and 584, and the metal layer 583 are adhered in the non-heated area of the metal layer 581 in the exemplary embodiment described above. However, both the heated area and the non-heated area may be adhered. Even in this case, the metal layer and the insulating layer adhere to each other in the non-heated area, and thus the gap formation is suppressed between the heating element and the insulating layer. In addition, the adhesion is performed also in the heated area, and a force suppressing the gap formation increases.

Figure 5:
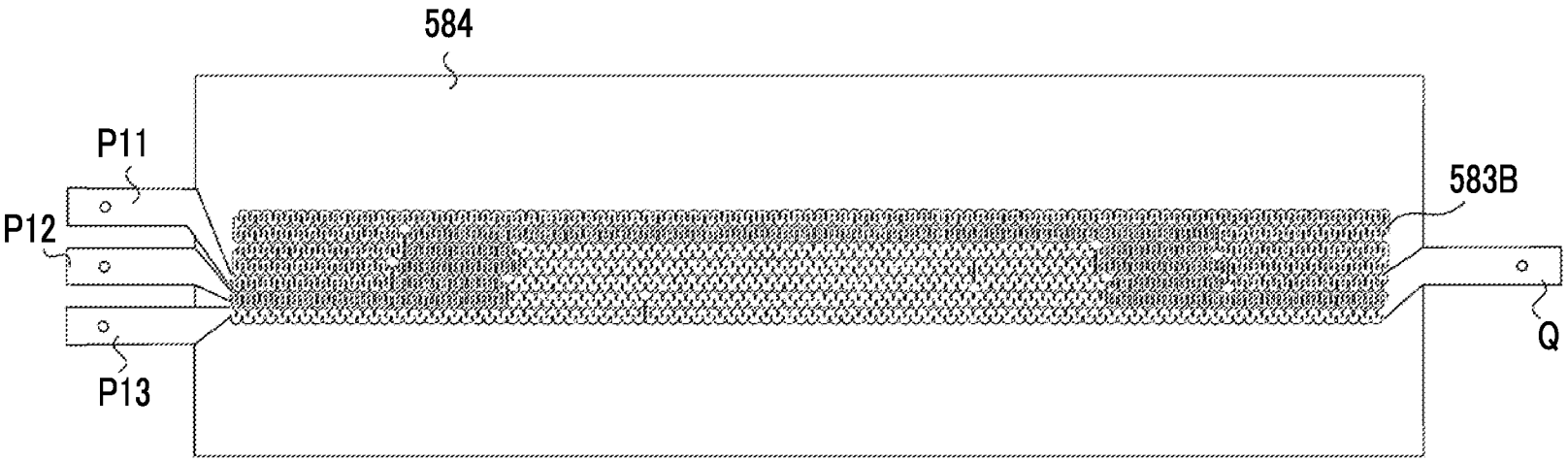
FIG. 5 is a view illustrating an example of a heating element.

(2) The metal layer 583 that has the heat generating portion 831 and the non-heat generating portions 832 and 833 is used in the exemplary embodiment described above. However, for example, a metal layer 583B (refer to FIG. 5) that does not have the non-heat generating portions 832 and 833 may be used.

(3) The heating unit 58 with a curved shape is used in the exemplary embodiment described above. However, the shape of the heating unit is not limited to the shape described in the exemplary embodiment described above. For example, the heating unit may have a non-curved shape. Even in this case, the metal layer and the insulating layer are adhered in the non-heated area, and thus the gap generation is suppressed between the heating element and the insulating layer.

Figure 6:
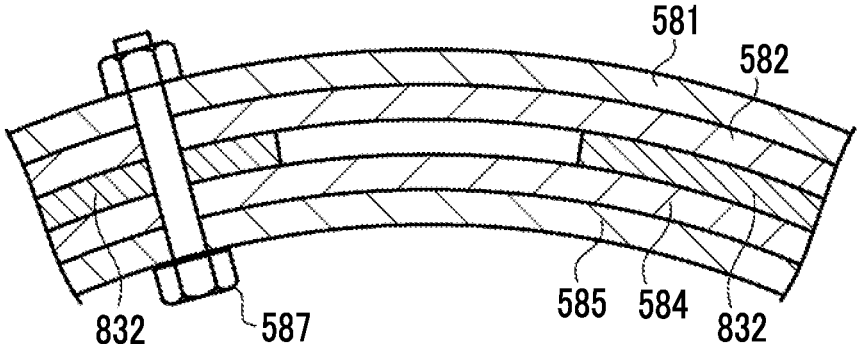
FIG. 6 is an enlarged sectional view illustrating a part of the heating unit.

(4) The thermoplastic adhesive is used as the connection member that connects the metal layer and the insulating layer in the exemplary embodiment described above. However, the connection member is not limited to the connection member described in the exemplary embodiment above. For example, as illustrated in FIG. 6, the non-heated area may be mechanically fixed by using a fixing member 587 such as a screw. In addition, the adhesive and the fixing member 587 such as the screw may be used in combination as the connection member.

(5) The image forming apparatus that includes the fixing unit 15 is not limited to the tandem type of the exemplary embodiment described above, and may have another configuration such as a rotary type. In addition, the image forming apparatus that includes the fixing unit 15 is not limited to the image forming apparatus that forms the image by stacking the toner images of plural colors, and may be an image forming apparatus that forms a single-colored toner image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device that heats a belt which transports a medium on which a non-fixed image to be fixed onto the medium through heating is formed, the heating device comprising:

a heating element;

a first insulating layer and a second insulating layer that are arranged to nip the heating element;

a first supporting layer that comes into contact with the first insulating layer and a second supporting layer that comes into contact with the second insulating layer, both of which are arranged to nip the first insulating layer, the heating element, and the second insulating layer; and a connection member that is configured to connect the first supporting layer and the second supporting layer in a normal direction of the first supporting layer and the second supporting layer, wherein the connection member is configured to connect the first supporting layer and the second supporting layer in the normal direction of the first supporting layer and the second supporting layer in an area where the heating element is absent, wherein the connection member is configured to not connect the first supporting layer and the second supporting layer in the normal direction of the first supporting layer and the second supporting layer in an area here the heating element is present.

2. The heating device according to claim 1, wherein a laminated body that includes the first insulating layer, the first supporting layer, the heating element, the second insulating layer, and the second supporting layer is curved in a state where the first supporting layer and the second supporting layer are connected in the normal direction.

3. The heating device according to claim 2, wherein the connection member includes a thermoplastic adhesive that adheres two of the first insulating layer, the first supporting layer, the heating element, the second insulating layer, and the second supporting layer that are adjacent to each other.

4. The heating device according to claim 2, wherein the connection member connects the first supporting layer and the second supporting layer in the normal direction of the first supporting layer and the second supporting layer in an area where the heating element is absent.

5. The heating device according to claim 4, further comprising:

a non-heating element that continues from the heating element, wherein the first insulating layer and the second insulating layer are arranged to nip the non-heating element, and wherein the connection member connects the non-heating element to the first insulating layer and the second insulating layer.

6. The heating device according to claim 2, further comprising:

a non-heating element that continues from the heating element, wherein the first insulating layer and the second insulating layer are arranged to nip the non-heating element, and wherein the connection member connects the non-heating element to the first insulating layer and the second insulating layer.

7. The heating device according to claim 3, wherein the connection member connects the first supporting layer and the second supporting layer in the normal direction of the first supporting layer and the second supporting layer in an area where the heating element is absent.

8. The heating device according to claim 3, further comprising:

a non-heating element that continues from the heating element, wherein the first insulating layer and the second insulating layer are arranged to nip the non-heating element, and wherein the connection member connects the non-heating element to the first insulating layer and the second insulating layer.

9. The heating device according to claim 7, further comprising:

a non-heating element that continues from the heating element, wherein the first insulating layer and the second insulating layer are arranged to nip the non-heating element, and wherein the connection member connects the non-heating element to the first insulating layer and the second insulating layer.

10. The heating device according to claim 1, wherein the connection member includes a thermoplastic adhesive that adheres two of the first insulating layer, the first supporting layer, the heating element, the second insulating layer, and the second supporting layer that are adjacent to each other.

11. The heating device according to claim 10, wherein the connection member connects the first supporting layer and the second supporting layer in the normal direction of the first supporting layer and the second supporting layer in an area where the heating element is absent.

12. The heating device according to claim 10, further comprising:

a non-heating element that continues from the heating element, wherein the first insulating layer and the second insulating layer are arranged to nip the non-heating element, and wherein the connection member connects the non-heating element to the first insulating layer and the second insulating layer.

13. The heating device according to claim 11, further comprising:

a non-heating element that continues from the heating element, wherein the first insulating layer and the second insulating layer are arranged to nip the non-heating element, and wherein the connection member connects the non-heating element to the first insulating layer and the second insulating layer.

14. The heating device according to claim 1, wherein the connection member connects the first supporting layer and the second supporting layer in the normal direction of the first supporting layer and the second supporting layer in an area where the heating element is absent.

15. The heating device according to claim 14, further comprising:

a non-heating element that continues from the heating element, wherein the first insulating layer and the second insulating layer are arranged to nip the non-heating element, and wherein the connection member connects the non-heating element to the first insulating layer and the second insulating layer.

16. The heating device according to claim 1, further comprising:

a non-heating element that continues from the heating element, wherein the first insulating layer and the second insulating layer are arranged to nip the non-heating element, and wherein the connection member connects the non-heating element to the first insulating layer and the second insulating layer.

17. A fixing device comprising:

a belt that transports a medium on which a non-fixed image to be fixed onto the medium through heating is formed; and the heating device according to claim 1 in which the first supporting layer is arranged to come into contact with the belt.

18. An image forming apparatus comprising:

an image forming unit that forms a non-fixed image to be fixed onto the medium through heating on the medium;

a transport unit that transports the medium on which the non-fixed image is formed by the image forming unit; and the fixing device according to claim 17 which fixes the non-fixed image onto the medium that is transported by the transport unit.

* * * * *